US012342950B2

(12) United States Patent
Day

(10) Patent No.: US 12,342,950 B2
(45) Date of Patent: Jul. 1, 2025

(54) CARPET STRETCHER

(71) Applicant: Paul Day, Bristol (GB)

(72) Inventor: Paul Day, Bristol (GB)

( * ) Notice: Subject to any disclaimer, the term of this patent is extended or adjusted under 35 U.S.C. 154(b) by 0 days.

(21) Appl. No.: 18/130,919

(22) Filed: Apr. 5, 2023

(65) Prior Publication Data

US 2023/0309729 A1 Oct. 5, 2023

(30) Foreign Application Priority Data

Apr. 5, 2022 (GB) ..... 2204970

(51) Int. Cl.
*A47G 27/04* (2006.01)

(52) U.S. Cl.
CPC ..... *A47G 27/0493* (2013.01)

(58) Field of Classification Search
CPC ..... A47G 27/0493
See application file for complete search history.

(56) References Cited

U.S. PATENT DOCUMENTS 303,619 A * 8/1884 Butterfield ..... A47G 27/0493 254/207
501,132 A * 7/1893 Blanchard ..... A47G 27/0493 254/212
593,898 A * 11/1897 Lawyer ..... A47G 27/0493 254/209
716,904 A * 12/1902 Lawson ..... A47G 27/0493 254/209
3,266,772 A * 8/1966 Francis ..... A47G 27/0493 294/8.6
3,300,182 A * 1/1967 Bussard ..... A47G 27/0493 D8/15
3,692,278 A * 9/1972 Payson ..... A47G 27/0493 254/212
3,951,382 A * 4/1976 Asbury ..... A47G 27/0493 254/204
3,952,997 A * 4/1976 Whitlock ..... A47G 27/0493 254/200
4,627,653 A * 12/1986 Koroyasu ..... A47G 27/0493 294/8.6
5,007,616 A 4/1991 Scarpino
5,855,361 A * 1/1999 Krowchak ..... B25B 25/00 254/209
5,938,182 A * 8/1999 Goodrich ..... A47G 27/0493 294/8.6

(Continued)

FOREIGN PATENT DOCUMENTS

CN 110897474 A 3/2020
GB 191120169 A 1/1912

*Primary Examiner* — Jason W San
*Assistant Examiner* — Matthew J Sullivan
(74) *Attorney, Agent, or Firm* — Jose Cherson Weissbrot

(57) ABSTRACT

A carpet stretcher comprising: a head mechanism; a tail mechanism; and an elongate extender; wherein the head mechanism is connected to a distal end of the elongate extender, and the tail mechanism is connected to a proximal end of the elongate extender; and wherein: the head mechanism comprises: a head element having a carpet engaging surface; an extension element for extending the elongate extender at its distal end so as to urge the head element distally; and a lever mechanism for actuating the extension element; characterised in that the tail mechanism comprises a tail element having a carpet engaging surface.

8 Claims, 3 Drawing Sheets

(56) References Cited

U.S. PATENT DOCUMENTS

| | | | | |
|---|---|---|---|---|
| 6,161,818 | A * | 12/2000 | Medwin | A47G 27/0493 254/200 |
| 6,994,323 | B2 * | 2/2006 | Carbajal | A47G 27/0493 254/206 |
| 7,451,961 | B2 * | 11/2008 | Kirker | A47G 27/0493 294/8.6 |
| 8,757,595 | B2 * | 6/2014 | Garzanelli | A47G 27/0493 254/210 |
| 10,856,685 | B2 * | 12/2020 | Wolf | A47G 27/0493 |
| 2009/0095943 | A1 * | 4/2009 | Thompson | A47G 27/0493 254/212 |
| 2012/0117916 | A1 * | 5/2012 | Flores | A47G 27/0493 254/212 |
| 2013/0248788 | A1 | 9/2013 | Garzanelli | |
| 2023/0117188 | A1 * | 4/2023 | Ruiz Ruiz | A47G 27/0493 254/209 |

* cited by examiner

CARPET STRETCHER

FIELD OF THE INVENTION

The invention relates to a carpet stretcher. Specifically, the invention relates to an extendable carpet stretcher, more specifically a carpet stretcher with a manually operable, lever actuated, extending stretching head.

BACKGROUND OF THE INVENTION

Laying a carpet correctly requires skill and diligence. Once a carpet has been cut to the approximate dimensions of the floor to be covered, it is laid on the floor. Because of the size of the carpet and its frictional engagement with the floor, as well as the natural capacity of the carpet fabric to expand and contract slightly, creases and bumps will inevitably form in the carpet once it has been set in place. For this reason, it is necessary to stretch the carpet out once it is in place.

Typical carpet stretching tools come in two broad categories. The first category is the knee kicker, which comprises a carpet engaging surface, typically a spiked pad, and a knee engaging surface, typically a cushioned pad which is substantially perpendicular to the spiked pad and rigidly connected to it. In use, the carpet layer presses the spiked pad into an area of carpet, and then, from a crouched position, knees the cushioned pad sharply. The carpet is thereby stretched in the direction of the impact. This process is repeated all around the edge of the carpet.

Knee kickers are small and light weight and formed of a single piece, therefore requiring no assembly. They are particularly suitable for laying small carpets, and using one to lay a large carpet would be extremely laborious. Repeated use of knee kickers has been known to result in injury.

The second category is the lever actuated carpet stretcher. These typically comprises a head with a carpet engaging surface, such as a spiked pad, and a tail having a wall engaging surface, typically another pad perpendicular to the first, separated by a modular pole. In use, the pole is assembled to a length sufficient for it to span the floor from one edge to another, opposite edge. The wall engaging surface is pressed up against one wall. The carpet engaging surface is pressed into an area of carpet close to, but not quite abutting, the opposite wall. A lever at the head end is actuated, urging the head closer to the wall, dragging the carpet with it via the carpet engaging surface, thus stretching the carpet. This process is repeated all around the edge of the carpet.

Lever actuated carpet stretchers are convenient for stretching much larger carpets because they do not require sudden physical impact with a user's knee and thus their use can be sustained safely for much longer. Nevertheless, they are heavy, and take their assembly is time consuming, especially for larger rooms in which more segments of pole must be assembled together in order to span the floor from one edge to the other.

A new apparatus for stretching carpets is desirable to overcome these deficiencies in the prior art. In particular, an apparatus is desirable which requires neither assembly, nor repeated sudden impact with the user's body. It should preferably be suitable for use on carpets of a wide range of sizes, while remaining lightweight and easily portable. The present invention seeks to achieve at least some of these goals.

SUMMARY OF THE INVENTION

Accordingly, the invention provides a carpet stretcher comprising: a head mechanism; a tail mechanism; and an elongate extender; wherein the head mechanism is connected to a distal end of the elongate extender, and the tail mechanism is connected to a proximal end of the elongate extender; and wherein: the head mechanism comprises: a head element having a carpet engaging surface; an extension element for extending the elongate extender at its distal end so as to urge the head element distally; and a lever mechanism for actuating the extension element; characterised in that the tail mechanism comprises a tail element having a carpet engaging surface.

Because it has a carpet engaging surface on both its head element and its tail element, rather than on just its head element as in the prior art, the carpet stretcher does not need to extend from one edge of a carpet to the opposite edge in order to function. This is because, in order to stretch a carpet close to a first edge of a room, the carpet stretch of the invention does not need to be braced against a wall at an opposite edge of the room. Instead, the carpet stretcher can be braced against an area of carpet elsewhere in the room, preferably a more central area of carpet. Thus, rather than stretching an area of carpet away from an opposite wall, the new carpet stretcher of the invention stretches to portions of carpet away from each other.

In some embodiments, the tail element further comprises a foot plate surface, opposite its carpet engaging surface, upon which a user can stand with at least one foot during use.

In order to more securely engage the tail with the carpet and thus brace against the urging of the head element by the lever mechanism more effectively, a first user may stand on a foot plate provided on the tail mechanism, while a second user actuates the lever mechanism to stretch the carpet. Without this feature, the carpet stretcher may, in some circumstances, be braced less securely than the prior art apparatuses which use an opposing wall for bracing. In some embodiments, the foot plate may be configured to support two feet. In other embodiments, it may be configured to support only one foot.

In some such embodiments, the tail element is pivotably connected to the proximal end of the elongate extender, so as to be lock-ably pivotable about an axis which is perpendicular to its carpet engaging surface.

A skilled carpet layers knows that stretching may occasionally require the application of non-perpendicular forces close to the carpet's edge. By providing for an adjustable bracing angle, such manoeuvres, and others that might be useful to the skilled user, are made easier.

In some embodiments, the elongate extender is telescopically extendable.

When a prior art lever actuated carpet stretcher is used, it stretched the whole length of the carpet from one edge to the other around the line defined by the carpet stretcher. The present invention stretches the carpet over a typically shorter length, only between the head and the tail. Thus, the longer the elongate extender of the invention, the more effective each stretching operation is when using it. Nevertheless, in order to avoid the time burden associated with assembling the apparatus of the prior art, carpet stretchers of the invention are preferably telescopically extendable rather than modular. This provides greater convenience, albeit a more limited range of lengths, which limitation is mitigated by the carpet engaging tail element as discussed above.

In some such embodiments, the elongate extender is lockable in a plurality of selectable states of extension.

In order to stretch an entire carpet using a carpet stretcher of the invention, the skilled user may find it preferable to place the tail mechanism close to the centre of the carpet for each stretching operation, while progressing the head mechanism all the way around the edge of the carpet. Thus, the length of the elongate extender is conveniently selectable and controllable so as to enable the user to select a precise length, at each operation, to extend the apparatus from the centre of the carpet to a selected portion of its edge.

In some embodiments, the head element may be pivotably connected to the distal end of the elongate extender, so as to be lock-ably pivotable about an axis which is perpendicular to its carpet engaging surface.

As discussed above in relation to the pivotable tail element, such arrangements improve the versatility of the apparatus.

In some embodiments, the carpet engaging surfaces of the head element and the tail element each comprises: a plurality of rigid carpet engaging spikes protruding from the carpet engaging surface.

An array of spikes is a preferred way of securely gripping a carpet without damaging it. The skilled person will appreciate the constraints on the density of the array and the lengths and diameters of the spikes in order for them to function properly.

In some such embodiments, the head mechanism and tail mechanism each comprises: an adjustable depth gauge mechanism comprising: a carpet engaging buffer, deployable from the carpet engaging surface between or around the rigid carpet engaging spikes, having a carpet engaging face which is substantially flush with the tips of the rigid carpet engaging spikes when at its maximal deployment; and a depth gauge actuator for deploying, retracting, and locking in place the carpet engaging buffer.

Carpets have a variety of depths, and the depth to which it is possible for the carpet engaging spikes to sink into the carpet should be selectable in order to avoid the spikes penetrating the whole depth of the carpet and damaging the floor beneath. Preferably, the carpet engaging spikes pierce the carpet backing in use, but do not penetrate the carpet backing far enough to engage with the floor beneath. Thus, a deployable buffer is used to stop the spikes sinking any deeper than a selected depth, adjustable with each use.

In some such embodiments, the direction of extension of the rigid carpet engaging spikes protruding from the carpet engagement surface of the head member has a component in the distal direction, and the direction of extension of the rigid carpet engaging spikes protruding from the carpet engagement surface of the tail element has a component in the proximal direction.

By slanting the head spikes distally and the tail spikes proximally, the stretching forces are better opposed by the spikes, and thus the carpet is held mores securely by the spikes during a stretching operation.

In some embodiments, the lever mechanism comprises a ratchet mechanism to prevent proximal retraction of the head element during an operation in which the lever is being actuated to urge the head element distally.

In order to fully and properly stretch the carpet with each stretching operation, it may be necessary to urge the head mechanism distally farther than can be achieved by a single actuation of the lever. By providing a ratchet mechanism, the lever can be actuated more than once without the progress of the previous actuation being lost.

A ratchet mechanism need not provide for multiple actuations of the lever. A simpler ratchet mechanism may be provided in which the progress of the lever is locked at discrete intervals during a single actuation, so that progress cannot be lost by the user inadvertently letting go of the lever.

Some embodiments further comprise a force gauge for measuring the distal force exerted in use by the head member on a carpet, and a display means which displays the measured force to the user.

Thanks to the leverage principle, the user is able to apply considerable force to the carpet in order to stretch it using the invention. Since each carpet has a maximum tolerance for an applied stretching force, it is beneficial in some embodiments for the user to be able to read the force currently being applied before deciding whether to apply more force, and thereby avoid damaging the carpet being stretched. The force gauge may also be used to prevent damage to the carpet stretcher apparatus itself. The display gauge may be marked at various tolerance levels to provide an easy in-use reference to the user and avoid the application of excessive force.

BRIEF DESCRIPTION OF DRAWINGS

Embodiments of the invention will now be described, by way of example only, with reference to the following drawings.

DETAILED DESCRIPTION

Throughout this specification, where use is made of relative positional terms such as upper, lower, top, bottom, above, or below, these should be understood assuming an 'in use' orientation, with the carpet engaging elements of the device in their carpet engaging positions relative to the rest of the device.

Figure 1:
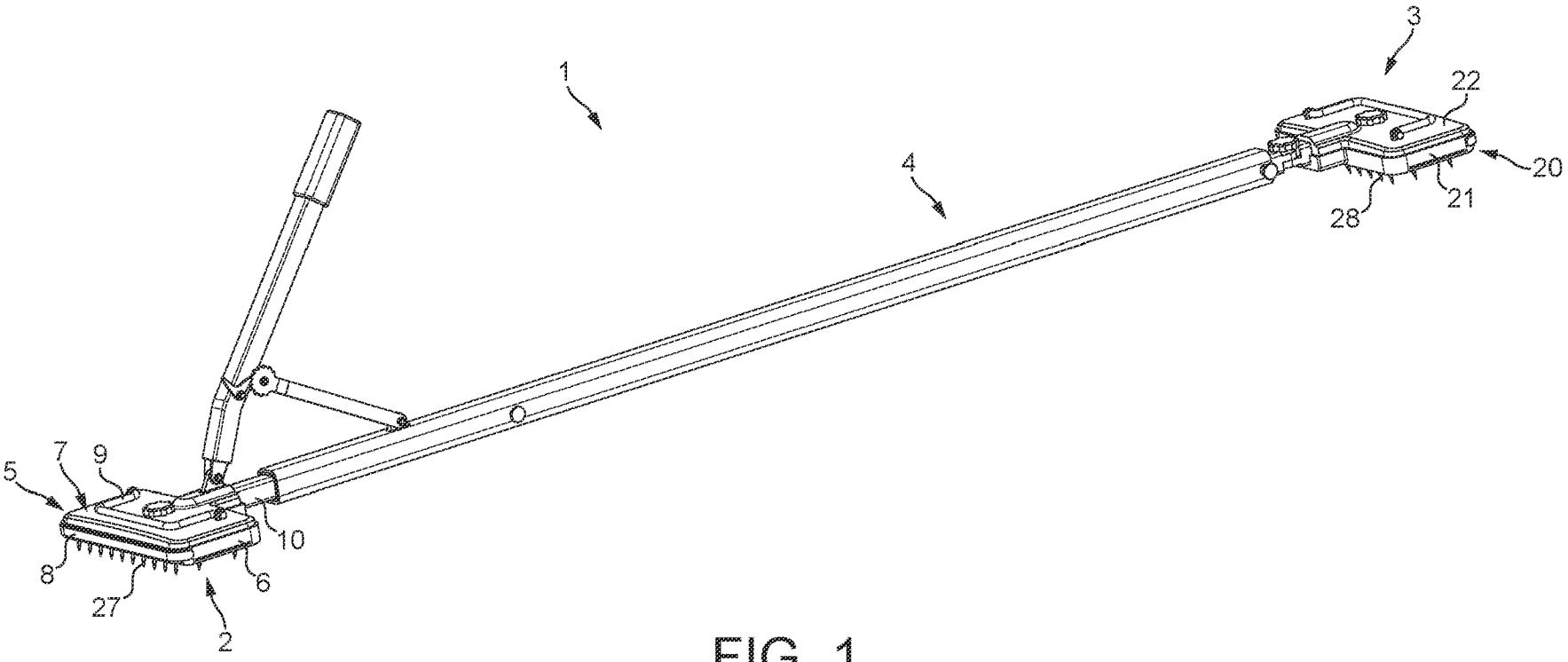
FIG. 1 depicts a carpet stretcher of the invention.
Figure 2:
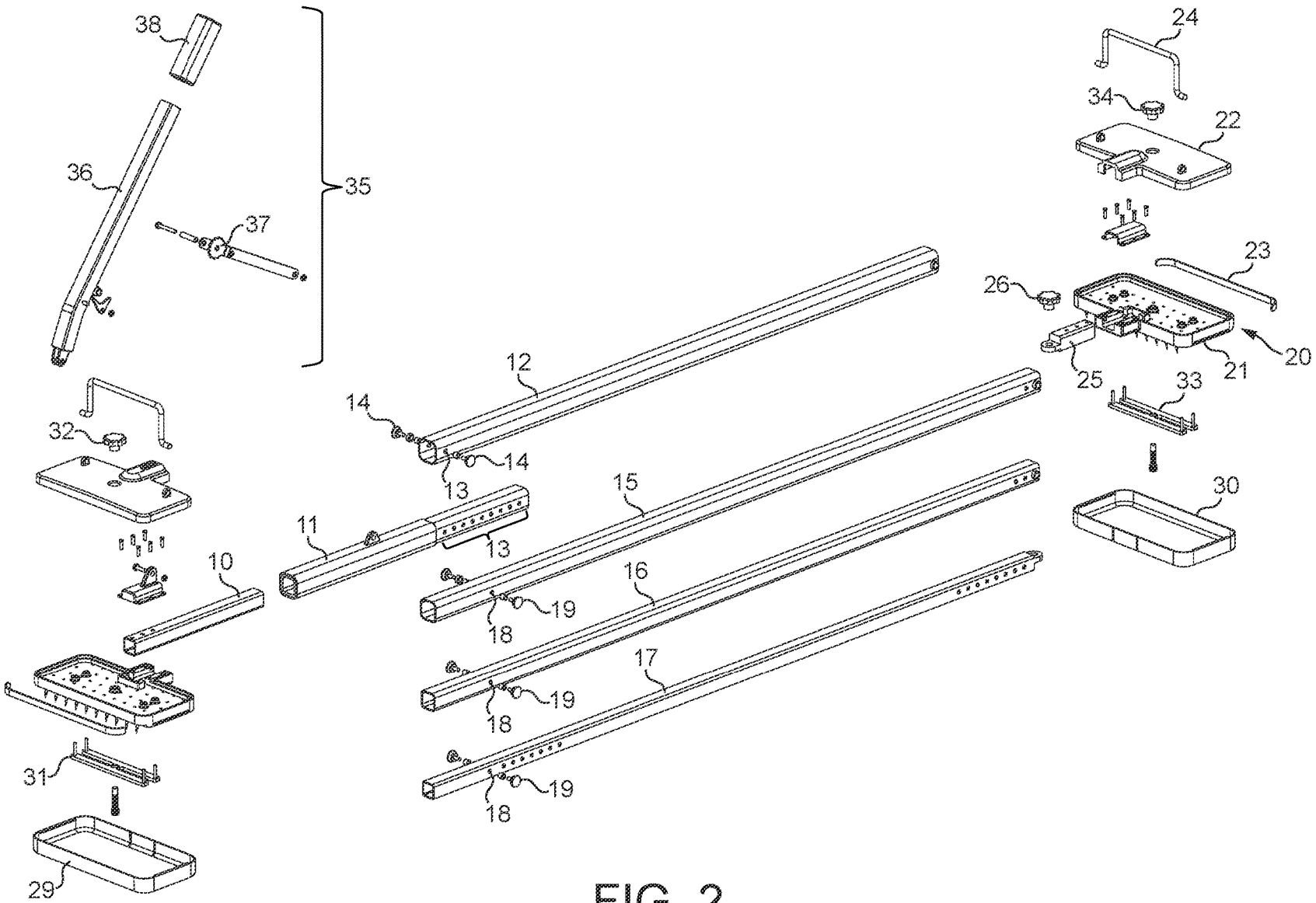
FIG. 2 depicts an exploded view of the carpet stretcher in FIG. 1, showing its component parts.

FIGS. 1 and 2 depict a carpet stretcher 1 according to a preferred embodiment of the invention. FIG. 1 shows an assembled carpet stretcher 1, and FIG. 2 is an exploded view of the same carpet stretcher 1, so that its components can be more easily identified.

The carpet stretcher 1 comprises a head mechanism 2, a tail mechanism 3, and an elongate extender 4.

The head mechanism comprises a head member 5 which is formed of a rectangular plate, preferably of aluminium, having a lower carpet engaging surface 6 and an upper surface 7. The upper surface 7 may be provided with a cover formed of injection moulded acrylonitrile butadiene styrene (ABS).

The front or distal edge of the head member 5 is protected by a strip of rubber material 8, or another suitable buffer. This prevents damage to a wall or skirting board in the event that the head member collides with the edge of a room in use.

A handle 9 is pivotably connected to the upper surface 7 of the head member 5. This allows for easy handling and carrying of the device 1.

The head mechanism 2 further comprises an extension element 10, extending proximally from its rear or proximal edge. The extension element 10 is an elongate stem which is slidably received in the hollow distal end of the elongate extender 4.

The elongate extender 4 is a telescopically extendable, modular pole of substantially square cross section, preferably formed of aluminium. Its distal-most module 11, into which the extension element 10 is slidably received, is itself slidably received by the proximally adjacent module 12. The length of the distal-most module 11 which extends from the distal end of the proximally adjacent module 12 can be adjusted, selected, and locked by means of a plurality of holes 13 and a pair of adjusting plungers 14. A user is therefore able to fine-tune the length of the elongate extender 4 to better suit the dimensions of the carpet to be stretched.

The elongate extender 4 further comprises additional modules 15-17. The proximal-most module 17 is slidably received by its distally adjacent module 16, which is slidably received by its distally adjacent module 15, which is slidably received by its distally adjacent module 12. Each of the additional modules 15-17 can be extended from its distally adjacent module, and can be locked in either an extended or an un-extended position by means of a series of holes 18 and adjusting plungers 19. Thus, the length of the elongate extender 4 can, in the depicted embodiment, be selected between 1.8 metres and 5 metres, depending on the dimensions of the carpet to be stretched.

The proximal-most module 17 has a plurality of holes 18 along its length, for additional fine-tuning of the length of the elongate extender.

The tail mechanism comprises a tail member 20 which is formed of a rectangular plate having a lower carpet engaging surface 21 and an upper surface 22. The upper surface 22 of the tail member 20 provides a foot plate surface on which a user can stand with at least one foot in use.

The rear or proximal edge of the tail member 20 is protected by a strip of rubber material 23, or another suitable buffer. This prevents damage to a wall or skirting board in the event that the tail member collides with the edge of a room in use. It also enables the user to use the novel carpet stretcher 1 of the invention in the conventional manner, bracing the tail 4 against an opposing wall or skirting board to stretch the carpet, rather than bracing it against a more central area of carpet. Thus, the carpet stretcher 1 of the invention combines the advantages of the prior art with its own novel advantages.

A handle 24 is pivotably connected to the upper surface 22 of the tail member 20. This allows for easy handling and carrying of the device 1.

The tail mechanism 3 further comprises a pivoting connector 25 extending from its front or distal edge. This is connected to the proximal end of the proximal-most module 17 of the elongate extender 4, in such a way as to be pivotable about a vertical axis. The angle between the elongate extender 4 and the tail member 20 can be locked about the pivot point using a locking screw 26.

A first set of carpet engaging spikes 27 protrudes from the lower surface 6 of the head member 5. The spikes are preferably aluminium, and integrally formed with the head member 5. When the lower surface 6 of the head member 5 is placed on an area of carpet, the spikes of the first set of carpet engaging spikes 27 sink into the carpet and lock the horizontal plane position of said area of carpet to the horizontal plane position of the head member 5.

Because, in use, the head member 5 exerts a distal force on a carpet, it is advantageous for the first set of carpet engaging spikes 27 to be angled so that the direction in which each spike of the first set of carpet engaging spikes 27 protrudes from the lower surface 6 of the head member 5 has a distal component.

A second set of carpet engaging spikes 28 protrudes from the lower surface 21 of the tail member 20. The spikes are preferably aluminium, and integrally formed with the tail member 20. When the lower surface 21 of the tail member 20 is placed on an area of carpet, the spikes of the second set of carpet engaging spikes 28 sink into the carpet and lock the horizontal plane position of said area of carpet to the horizontal plane position of the tail member 20.

Because, in use the tail member 20 exerts a proximal force on a carpet, it is advantageous for the second set of carpet engaging spikes 28 to be angled so that the direction in which each spike of the second set of carpet engaging spikes 28 protrudes from the lower surface 21 of the tail member 20 has a proximal component.

Snap fit covers 29, 30 are provided for both the lower surface 6 of the head member 5 and the lower surface 21 of the tail member 20, preferably formed of injection moulded polypropylene. When the device 1 is not in use, that is, when the spikes of the first and second sets of carpet engaging spikes 27, 28 are not engaged with a carpet, the covers 29, 30 should be fitted so as to cover the spikes and prevent unwanted scratching or piercing of objects or persons by the spikes.

A head depth gauge 31 is deployable from the lower surface 6 of the head member 5. This comprises a pair of parallel, narrow plates, preferably formed of aluminium, which are located between rows of spikes of the first set of carpet engaging spikes 27. These plates can be raised or lowered relative to the head member 5 by turning a threaded bolt using an actuator 32 provided on the upper surface 7 of the head member 5. As the spikes of the first set of carpet engaging spikes 27 are sinking into a carpet, they are prevented from sinking farther when the carpet engages with the head depth gauge 31. Thus, the head depth gauge 31 is lowered for use with a shallow carpet, in order to avoid the spikes scratching the floor beneath the carpet by sinking too deeply, and is raised for use with a deep carpet, in order to ensure adequate engagement for stretching.

Similarly, a tail depth gauge 33 is deployable from the lower surface 21 of the tail member 20. This comprises a second pair of parallel, narrow plates, preferably formed of aluminium, which are located between rows of spikes of the second set of carpet engaging spikes 28. These plates can be raised or lowered relative to the tail member 20 by turning a threaded bolt using an actuator 34 provided on the upper surface 22 of the tail member 20. As the spikes of the second set of carpet engaging spikes 28 are sinking into a carpet, they are prevented from sinking farther when the carpet engages with the tail depth gauge 33. Thus, the tail depth gauge 33 is lowered for use with a shallow carpet, and raised for use with a deep carpet, in the same way as the head depth gauge 31.

A lever mechanism 35 connects the extension element 10 and the distal-most module 11 of the elongate extender 4. The lever mechanism comprises a lever handle 36 and a pivoting connector 37. The lever handle 36 is preferably formed of aluminium, and is pivotably connected at its distal end to the extension element 10. The pivoting connector 37 is preferably formed of stainless steel and is pivotably connected at its proximal end to the distal-most module 11 of the elongate extender 4, and is pivotably connected at its distal end to a point towards the distal end of the lever handle 36.

A rubber handle 38 may be provided at the proximal end of the lever handle 36, to improve both the grip and the comfort of a user when actuating the lever mechanism 35.

The pivotable connection between the lever handle 36 and the pivoting connector 37 comprises a ratchet mechanism so that, during a levering operation, it can only pivot in one direction, so that the lever handle 36 can only be pivoted proximally. Actuating the lever, in use, causes the extension element 10 and thus the head element 5 to be urged distally with respect to the elongate extender 4 and the tail mechanism 3, and it is this which causes the stretching of the carpet.

Figure 3:
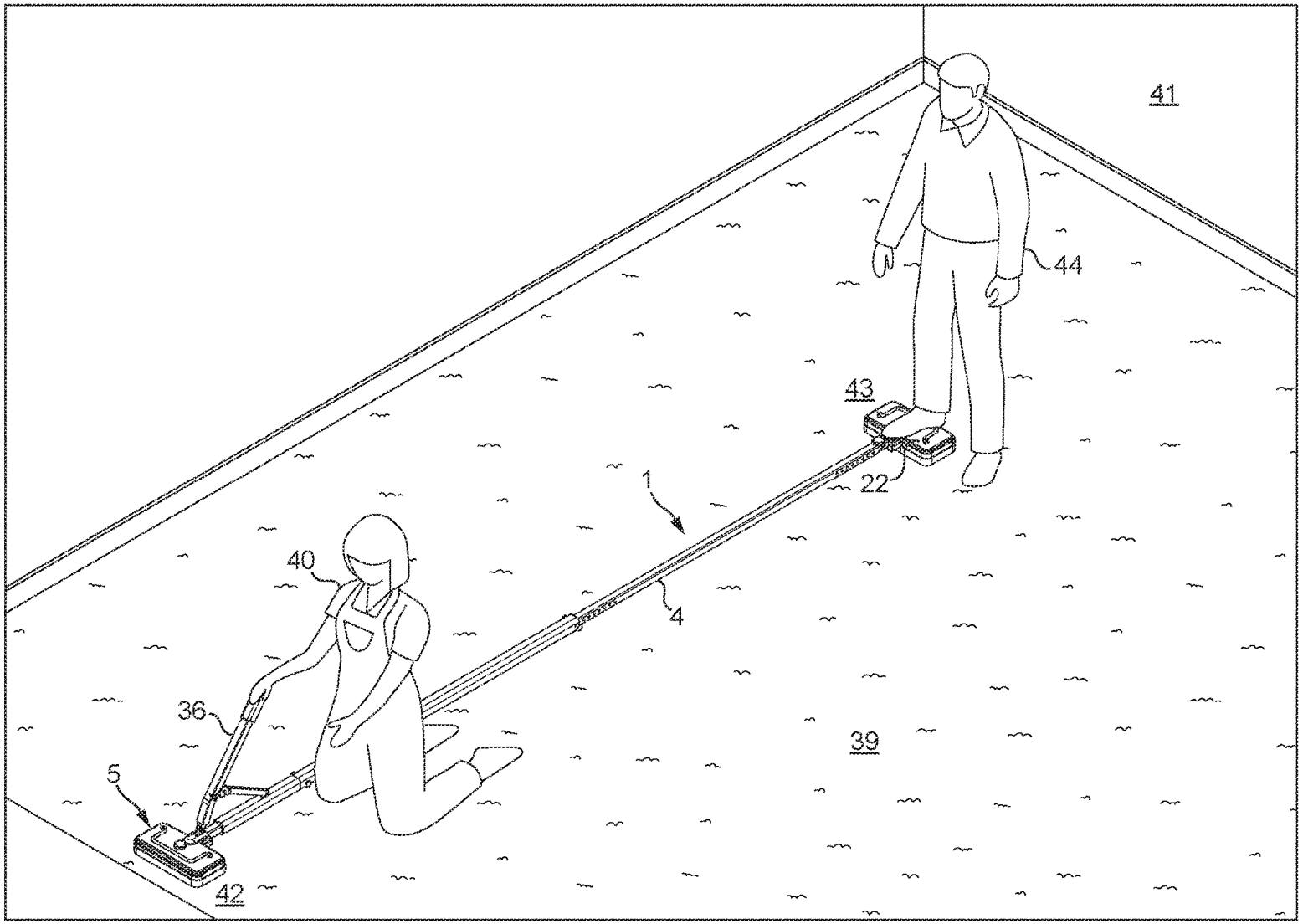
FIG. 3 depicts an embodiment of a carpet stretcher of the invention in use.

A method of stretching a carpet using a carpet stretcher according to the invention will now be described, with reference to FIG. 3.

When laying a carpet 39 using the carpet stretcher 1 of the invention, the user 40 will first select the appropriate length for the carpet stretcher 1 according to the size of the carpet 39. The embodiment described above can be extended from 1.8 metres to 5 metres. If the carpet 39 is too large to use the carpet stretcher 1 in the conventional way in which the tail member 20 is braced against a wall 41 opposite the part 42 of the carpet to be stretched, the length of the telescopic elongate extender 4 is selected so that the carpet stretcher 1 will extend from an area 43 approximately in the centre of the carpet to the edge 42 of the carpet to be stretched.

The depth gauges 31, 33 should be adjusted to suit the depth of the carpet to be stretched, and the snap fit covers 29, 30 should be removed, and then the carpet stretcher 1 can be positioned with the lower surface 21 of the tail member 20 engaging an area of carpet 43 approximately in the centre of the carpet 39, and the lower surface 6 of the head member 5 close to a first edge portion 42 of the carpet to be stretched. The spikes of the first and second sets of carpet engaging spikes 27, 28 will secure the head member 5 and tail member 20 to the carpet 39. Preferably, a second user stands on the upper surface 22 of the tail member 20 to secure it more firmly in place.

The lever handle 36 is then pivoted proximally by the user 40, urging the head member 5 distally, and stretching the carpet at the selected edge portion 42. The user 40 will pay attention to the force gauge (not shown), if one is provided, to ensure that neither the carpet 39 nor the carpet stretcher 1 is damaged by excessive urging of the head member 5.

Once the first selected portion 42 of carpet is satisfactorily stretched, the users 40, 44 adjust the position of the carpet stretcher 1 so that its head member 5 engages with an adjacent edge portion of the carpet 39, and the stretching operation is repeated. Once every edge portion of the carpet 39 has been stretched, the operation is complete.

Although the invention has been described above with reference to a particular preferred embodiment, the scope of the invention is not limited to that embodiment. Where particular material and configurations are named for the various components of the invention, the skilled reader will appreciate that other materials and configurations may be suitable to achieve the same purpose, and may be preferable in some embodiments. The scope of the invention is limited only by the claims.

What is claimed is:

1. A carpet stretcher, comprising: a head mechanism; a tail mechanism; and an elongate extender; wherein the head mechanism is connected to a distal end of the elongate extender, and the tail mechanism is connected to a proximal end of the elongate extender; and wherein: the head mechanism comprises: a head element having a carpet engaging surface; an extension element for extending the elongate extender at its distal end so as to urge the head element distally; and a lever mechanism for actuating the extension element; characterized in that the tail mechanism comprises a tail element having a carpet engaging surface, wherein the carpet engaging surface of each of the head element and the tail element comprises a plurality of rigid carpet engaging spikes having a plurality of tips protruding from each of the carpet engaging surface, and each of the head mechanism and the tail mechanism comprises an adjustable depth gauge mechanism, the adjustable depth gauge mechanism comprises a carpet engaging buffer, deployable from the carpet engaging surface between the plurality of rigid carpet engaging spikes, the carpet engaging buffer has a carpet engaging face substantially flush with the plurality of the tips of the rigid carpet engaging spikes based on the rigid carpet engaging spikes are at a maximal deployment; and a depth gauge actuator for deploying, retracting, and locking to place the carpet engaging buffer.

2. A carpet stretcher according to claim 1 wherein the tail element further comprises a foot plate surface, opposite its carpet engaging surface, upon which a user can stand with at least one foot during use.

3. A carpet stretcher according to claim 2 wherein the tail element is pivotably connected to the proximal end of the elongate extender, so as to be lockably pivotable about an axis which is perpendicular to its carpet engaging surface.

4. A carpet stretcher according to claim 1 wherein the elongate extender is telescopically extendable.

5. A carpet stretcher according to claim 4 wherein the elongate extender is lockable in a plurality of selectable states of extension.

6. A carpet stretcher according to claim 1, wherein the direction of extension of the rigid carpet engaging spikes protruding from the carpet engagement surface of the head member has a component in the distal direction, and the direction of extension of the rigid carpet engaging spikes protruding from the carpet engagement surface of the tail element has a component in the proximal direction.

7. A carpet stretcher according to claim 1 wherein the lever mechanism comprises a ratchet mechanism to prevent proximal retraction of the head element during an operation in which the lever is being actuated to urge the head element distally.

8. A carpet stretcher according to claim 1 further comprising a force gauge for measuring the distal force exerted in use by the head member on a carpet, and a display means which displays the measured force to the user.

* * * * *